US008402938B2

(12) United States Patent
Hah

(10) Patent No.: US 8,402,938 B2
(45) Date of Patent: Mar. 26, 2013

(54) INTERNAL COMBUSTION ENGINE HAVING DIFFERENT STROKE DISTANCES

(76) Inventor: Byung Hahn Hah, Houston, TX (US)

( * ) Notice: Subject to any disclaimer, the term of this patent is extended or adjusted under 35 U.S.C. 154(b) by 434 days.

(21) Appl. No.: 12/873,930

(22) Filed: Sep. 1, 2010

(65) Prior Publication Data

US 2011/0048392 A1 Mar. 3, 2011

(30) Foreign Application Priority Data

Sep. 2, 2009 (KR) ..... 10-2009-0082726

(51) Int. Cl.
*F02B 75/32* (2006.01)

(52) U.S. Cl. ..... 123/197.4; 123/197.1

(58) Field of Classification Search ..... 123/197.1, 123/197.4; 74/579 E
See application file for complete search history.

(56) References Cited

U.S. PATENT DOCUMENTS 4,319,498 A * 3/1982 McWhorter ..... 74/595

* cited by examiner

*Primary Examiner* — Noah Kamen
(74) *Attorney, Agent, or Firm* — IPLA P.A.; James E. Bame

(57) ABSTRACT

An internal combustion engine comprises a rotating connector engaged rotatably in the rotatable receptacle. The rotating connector includes two rotational axles, two radial arms extending from the rotational axles, and an off-center middle axle connected to the two radial arms, and the two rotational axles share a common axis and are parallel to the off-center middle axle. The upper end is rotatably connected to the off-center middle axle of the rotating connector and the lower end is rotatably connected to the crankshaft. The internal combustion engine goes through an engine cycle comprising an intake phase, a compression phase, a expansion phase, and a exhaust phase. During the intake and compression phases the piston travels between a top dead center and a first bottom dead center. During the compression and exhaust phases the piston travels between a second bottom dead center to the top dead center.

12 Claims, 5 Drawing Sheets

INTERNAL COMBUSTION ENGINE HAVING DIFFERENT STROKE DISTANCES

BACKGROUND OF THE INVENTION

Technical Field

The present invention relates to a piston structure in an internal combustion engine, and more particularly to an improved piston cycling mechanism capable of enhancing engine power and fuel efficiency by differentiating a travel distance of a piston between the expansion phase and the compression phase.

Prior arts have been suggesting a number of approaches to increase a fuel efficiency and output power of the engine. Some try to adjust a combustion environment of fuel inside the engine during an expansion phase in order to convert the combustion energy to power efficiently. Still other methods try to facilitate an efficient conversion when the power of the combustion energy to a moment of crankshaft.

In prior arts, the strokes or phases in a cycle of the engine have a same distance of travel in a cylinder. This distance is same as the diameter of rotation of a crankshaft. If the travel distance of the phases can be adjusted, it may be possible to control some environment or even efficiency and output of the internal combustion engine.

The change of travel distance of the piston may result in the change of space where the combustion energy is converted to power. Also, when the rotational diameter of the crankshaft is related to the travel distance of the piston, the moment of the crankshaft can be adjusted.

The invention has been needed for solving the above problems in the prior arts, and provides solutions for increasing efficiency of internal combustion engines using gasoline, hydrogen, and diesel as fuel.

SUMMARY OF THE INVENTION

This invention is contrived to overcome the conventional disadvantages. Accordingly, an objective of the invention is to provide a crank piston structure for internal combustion engine, which can adjust piston travel distances or piston stroke distances in some phases of the engine.

Another objective is to provide a piston cycling mechanism enhancing engine power and fuel efficiency by differentiating a travel distance of a piston between the expansion phase and the compression phase.

To achieve these and other objectives, an internal combustion engine comprises a cylinder, a piston, a rotatable receptacle, a rotating connector, a crankshaft, and a connecting rod. The cylinder includes a top wall portion, a side wall portion, and a bottom opening. The piston is configured to travel through the cylinder, the piston comprising a top plate portion and a side plate portion extending from the top plate. The rotatable receptacle is provided on inner surface of the side plate portion of the piston.

The rotating connector engages rotatably in the rotatable receptacle. The rotating connector includes two rotational axles, two radial arms extending from the rotational axles, and an off-center middle axle connected to the two radial arms, and the two rotational axles share a common axis and are parallel to the off-center middle axle. The crankshaft is disposed below the cylinder.

The connecting rod includes a upper end and a lower end. The upper end is rotatably connected to the off-center middle axle of the rotating connector and the lower end is rotatably connected to the crankshaft. The internal combustion engine goes through an engine cycle comprising an intake phase, a compression phase, a expansion phase, and a exhaust phase.

During the intake phase the piston travels from a top dead center of the cylinder to a first bottom dead center of the cylinder. During the compression phase the piston travels from the first bottom dead center of the cylinder to the top dead center of the cylinder. During the expansion phase the piston travels from the top dead center of the cylinder to a second bottom dead center. Further, during the exhaust phase the piston travels from the second bottom dead center of the cylinder to the top dead center.

The piston reaches the first bottom dead center when the off-center middle axle of the rotating connector rotates downward to a lowest point. The piston reaches the second bottom dead center when the off-center middle axle of the rotating connector rotates upward to a highest point.

The rotatable receptacle can comprise two holes provided in the inner surface of the side plate portion of the piston, and each of the two holes can comprise a plurality of bearings configured to support rotatably the rotating connector. The off-center middle axle can be apart from the two rotational axles by a predetermined vertical distance, R, and the R can be a rotational radius of the rotating connector.

A travel distance of the piston during the expansion phase or the exhaust phase can be longer than a travel distance of the piston during the intake phase or the compression phase. The travel distance of the piston during the expansion phase or the exhaust phase can be approximately 2.0 times R longer than the travel distance of the piston during the intake phase or the compression phase. The R can be smaller than a radius of the piston.

At a starting point of time of the intake phase the piston can stay at the top dead center while the off-center middle axle of the rotating connector rotates downward by 180 degrees. At a starting point of time of the compression phase the piston can stay at the first bottom dead center while the off-center middle axle of the rotating connector rotates upward by 180 degrees. The off-center middle axle of the rotating connector can stay at a highest point without rotation during the expansion phase.

The off-center middle axle of the rotating connector can stay at a highest point without rotation during the exhaust phase. A fuel for the internal combustion engine can comprise gasoline, hydrogen, and diesel. The internal combustion engine may further comprise an intake valve, an exhaust valve, and a spark plug.

Therefore, according to the invention, it is possible to change one of the travel distance of the piston during one or two phases of the engine. The increased travel distance of the piston means that the size of the space in the cylinder may be increased such that the conversion from a fuel to power gets more efficient. The increased travel distance of the piston may be given by the diameter of rotation of a rotating connector.

DETAILED DESCRIPTION OF PRESENT INVENTION

Figure 4:
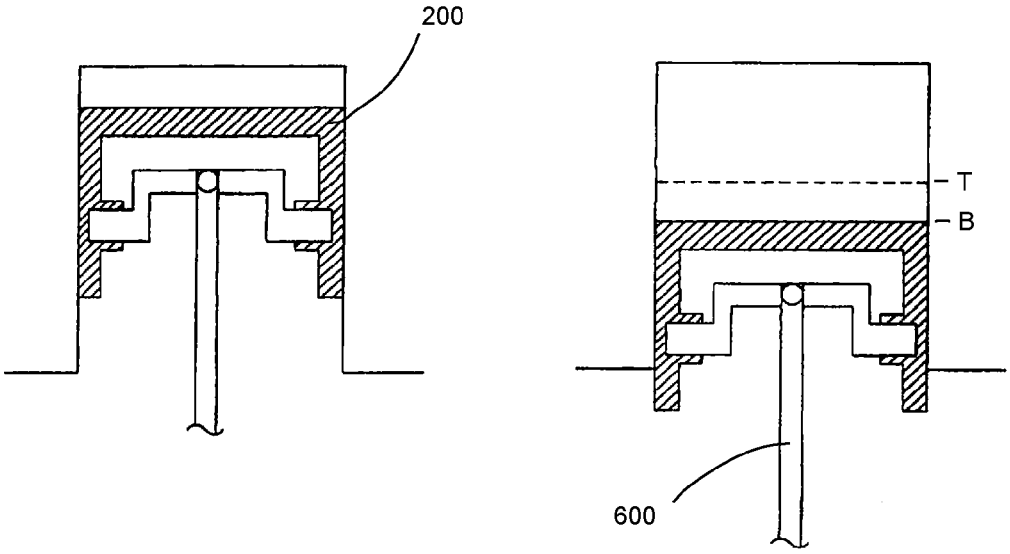
FIG. 4 is a diagram showing an expansion phase according to an embodiment of the invention.
Figure 5:
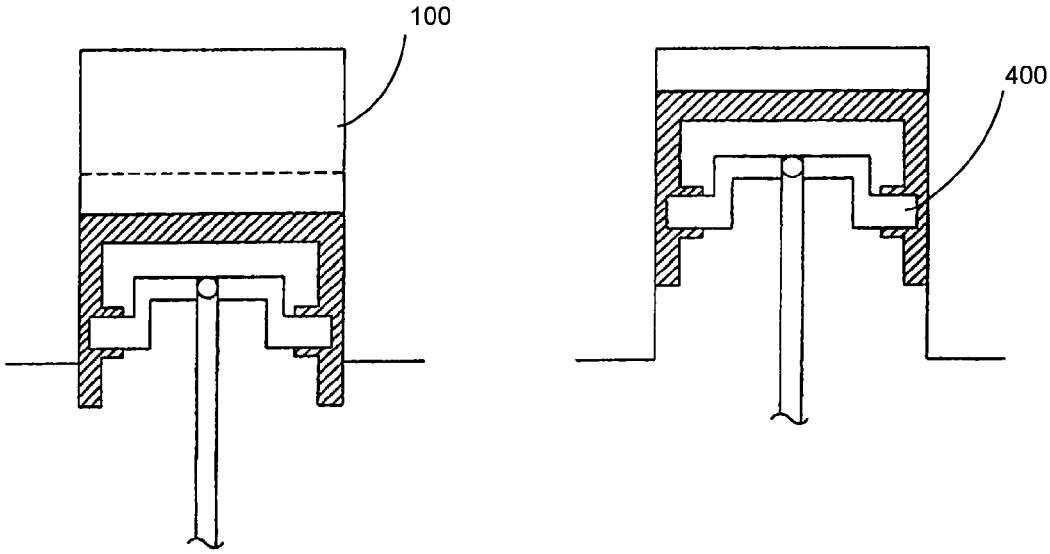
FIG. 5 is a diagram showing an exhaust phase according to an embodiment of the invention.
Figure 6:
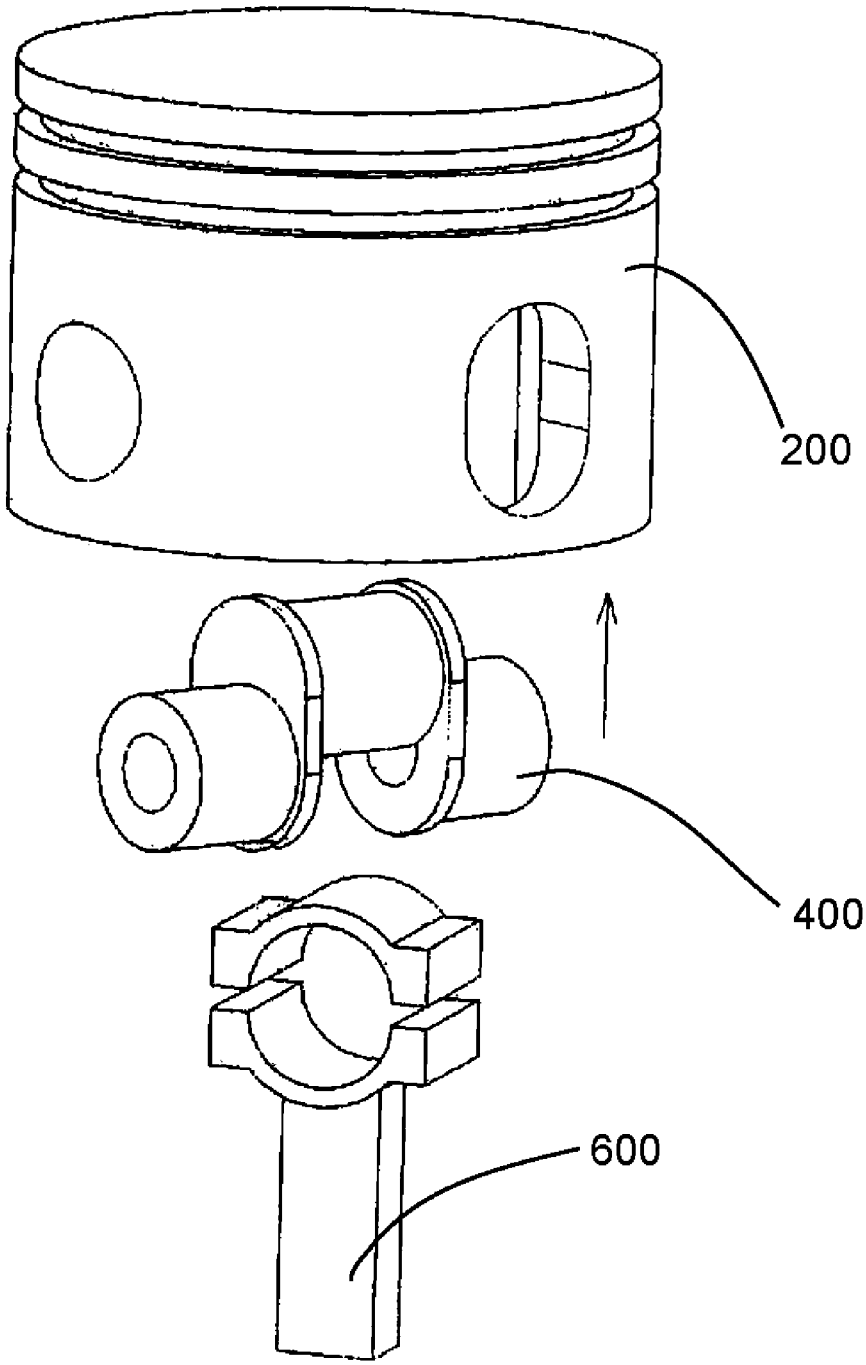
FIG. 6 is a diagram showing an assembly of the embodiment of the invention.
Figure 7:
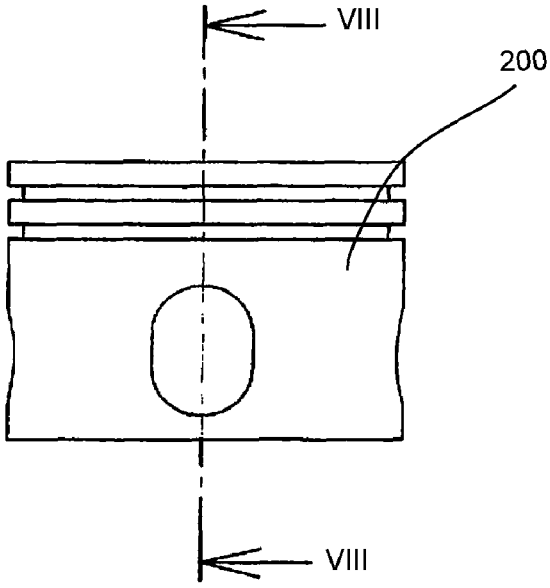
FIG. 7 is a diagram showing structure of a piston according to an embodiment of the invention.
Figure 8:
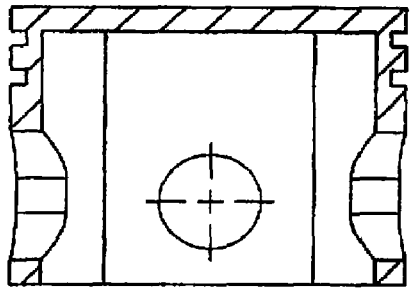
FIG. 8 is a cross-sectional view taken along VIII-VIII in FIG. 7.

FIGS. 1-5 show an internal combustion engine according to embodiments of the invention, and FIGS. 6-8 show some parts of the internal combustion engine.

Figure 1:
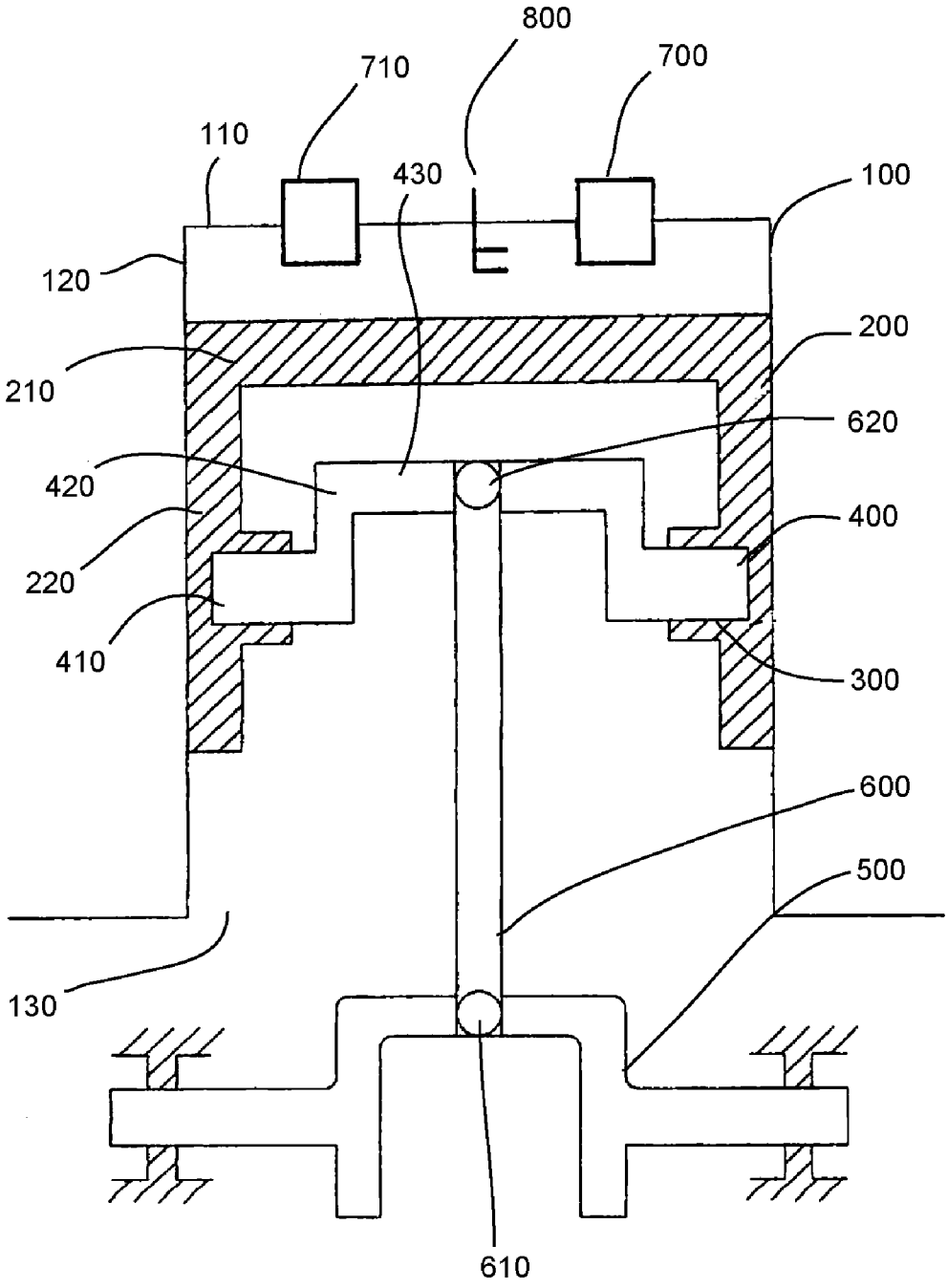
FIG. 1 is a cross-sectional view showing an internal combustion engine according to an embodiment of the invention.

An internal combustion engine comprises a cylinder 100, a piston 200, a rotatable receptacle 300, a rotating connector 400, a crankshaft 500, and a connecting rod 600 as shown in FIG. 1. The cylinder 100 includes a top wall portion 110, a side wall portion 120, and a bottom opening 130 as shown in FIG. 1.

The piston 200 is configured to travel through the cylinder 100, the piston 200 comprising a top plate portion 210 and a side plate portion 220 extending from the top plate 220 as shown in FIGS. 1, 7, and 8. The rotatable receptacle 300 is provided on inner surface of the side plate portion 220 of the piston 200 as shown in FIG. 1.

The rotating connector 400 engages rotatably in the rotatable receptacle 300. The rotating connector 400 includes two rotational axles 410, two radial arms 420 extending from the rotational axles 410, and an off-center middle axle 430 connected to the two radial arms 420, and the two rotational axles 410 share a common axis and are parallel to the off-center middle axle 430. The rotating connector 400 is shown in FIGS. 1 and 6.

The crankshaft 500 is disposed outside of and below the cylinder 100 as shown in FIG. 1. The connecting rod 600 includes a upper end 610 and a lower end 620. The upper end 610 is rotatably connected to the off-center middle axle 430 of the rotating connector 400 and the lower end 620 is rotatably connected to the crankshaft 500 as shown in FIGS. 1 and 6.

The internal combustion engine goes through an engine cycle comprising an intake phase, a compression phase, a expansion phase, and a exhaust phase.

Figure 2:
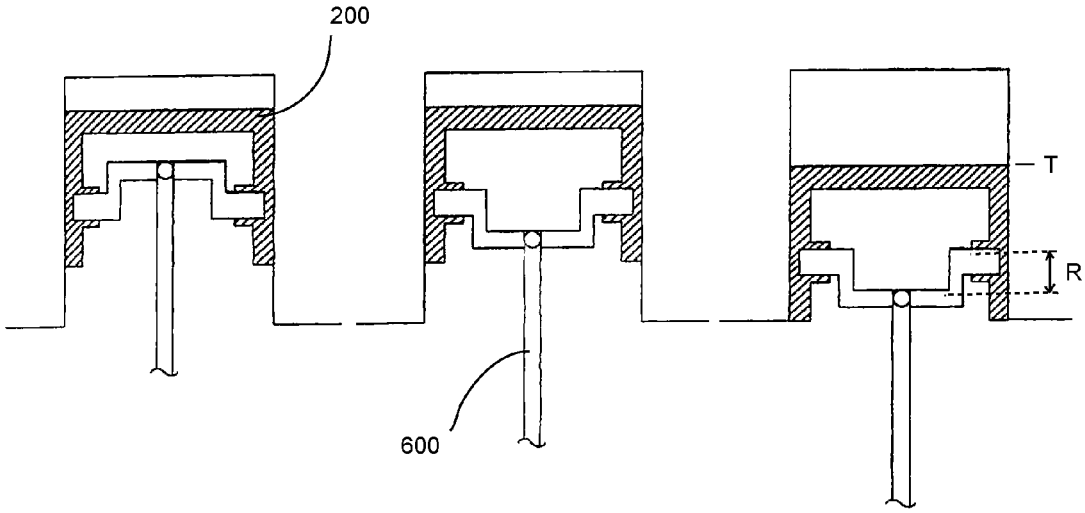
FIG. 2 is a diagram showing an intake phase according to an embodiment of the invention.
Figure 3:
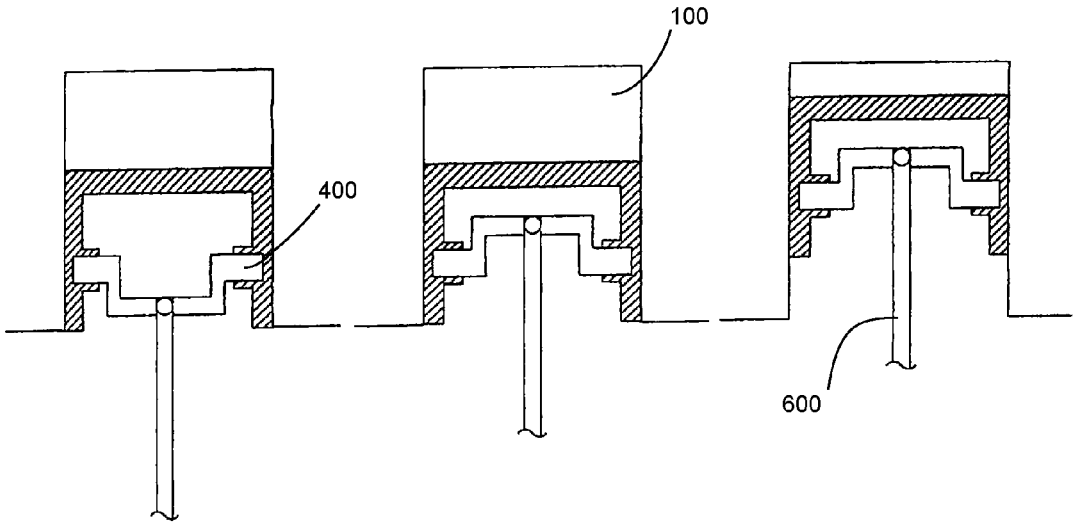
FIG. 3 is a diagram showing a compression phase according to an embodiment of the invention.

FIG. 2 shows an intake phase according to an embodiment of the invention. FIG. 3 shows a compression phase according to an embodiment of the invention. FIG. 4 shows an expansion phase according to an embodiment of the invention. FIG. 5 shows an exhaust phase according to an embodiment of the invention.

During the intake phase shown in FIG. 2, the piston 200 travels from a top dead center of the cylinder 100 to a first bottom dead center of the cylinder 100. The top dead center can be seen in the first figure in FIG. 2, which is the point of the top surface of the piston 200 in the cylinder 100. The first bottom dead center is represented by T in the third figure in FIG. 2. The piston 200 does not move until the crankshaft 500 rotates downward by 180 degrees. The fuel starts to be introduced into the cylinder when the crankshaft rotates by 180 degrees.

For a better performance, during the compression phase shown in FIG. 3, the piston 200 travels from the first bottom dead center of the cylinder 100 to the top dead center of the cylinder 100. The piston 200 does not move until the crankshaft 500 rotates upward by 180 degrees. When the piston 200 starts to move upward, the compression of fuel starts. At the end of the compression phase, the piston 200 reaches the top dead center.

During the expansion phase shown in FIG. 4, the piston 200 travels from the top dead center of the cylinder 100 to a second bottom dead center B. The second bottom dead center is represented by B in the second figure in FIG. 4. The piston 200 moves downward due to the explosion and expansion of fuel in the cylinder 100. The rotating connector 400 does not rotate during the expansion phase keeping the initial state.

Further, during the exhaust phase shown in FIG. 5, the piston 200 travels from the second bottom dead center B of the cylinder 100 to the top dead center. The connecting rod 600 moves upward due to the rotational force of the crankshaft 500. The rotating connector 400 does not rotate during the expansion phase keeping the initial state. Still the piston 200 is pushed to move upward. At the end of the exhaust phase, the piston 200 is at the top dead center.

The piston 200 reaches the first bottom dead center T when the off-center middle axle of the rotating connector 400 rotates downward to a lowest point as shown in the third figure of FIG. 2 and the first figure of FIG. 3.

The piston 200 reaches the second bottom dead center B when the off-center middle axle 430 of the rotating connector 400 rotates upward to a highest point as shown in the second figure of FIG. 4 and the first figure of FIG. 5.

The rotatable receptacle 300 can comprise two holes provided in the inner surface of the side plate portion of the piston 200, and each of the two holes can comprise a plurality of bearings (not shown) configured to support rotatably the rotating connector 400 as shown FIG. 1.

The off-center middle axle 430 can be apart from the two rotational axles 410 by a predetermined vertical distance, R, and the R can be a rotational radius of the rotating connector 400.

In this construction, a travel distance of the piston 200 during the expansion phase as shown in FIG. 4 or the exhaust phase as shown in FIG. 5 can be longer than a travel distance of the piston 200 during the intake phase as shown in FIG. 2 or the compression phase as shown in FIG. 3.

The travel distance of the piston 200 during the expansion phase or the exhaust phase can be approximately 2.0 times R longer than the travel distance of the piston 200 during the intake phase or the compression phase. The R can be smaller than a radius of the piston 200.

In an embodiment, at a starting point of time of the intake phase the piston 200 can stay at the top dead center while the off-center middle axle 430 of the rotating connector 400 rotates downward by 180 degrees.

At a starting point of time of the compression phase the piston 200 can stay at the first bottom dead center T while the off-center middle axle 430 of the rotating connector 400 rotates upward by 180 degrees.

The off-center middle axle 430 of the rotating connector 400 can stay at a highest point without rotation during the expansion phase. Also, the off-center middle axle 430 of the rotating connector 400 can stay at a highest point without rotation during the exhaust phase.

A fuel for the internal combustion engine can comprise gasoline, hydrogen, and diesel.

The internal combustion engine may further comprise an intake valve 700, an exhaust valve 710, and a spark plug 800 as shown in FIG. 1. The functions of the valves 700, 710 and the spark plug 800 are same as in prior arts. They may be controlled mechanically or electronically so as to introduce the fuel, to provide an electrical spark to ignite the fuel, or to remove exhaust gas from the cylinder 100.

Although a preferred embodiment of the present invention is disclosed for illustrative purposes, those skilled in the art will appreciate that various modifications, additions and substitutions are possible, without departing from the scope and spirit of the invention as disclosed in the accompanying claims.

What is claimed is:

1. An internal combustion engine comprising:

a cylinder comprising a top wall portion, a side wall portion, and a bottom opening;

a piston configured to travel through the cylinder, the piston comprising a top plate portion and a side plate portion extending from the top plate;

a rotatable receptacle provided on inner surface of the side plate portion of the piston;

a rotating connector engaging rotatably in the rotatable receptacle, the rotating connector comprising two rotational axles, two radial arms extending from the rotational axles, and an off-center middle axle connected to the two radial arms, wherein the two rotational axles share a common axis and are parallel to the off-center middle axle;

a crankshaft disposed below the cylinder; and a connecting rod comprising a upper end and a lower end, wherein the upper end is rotatably connected to the off-center middle axle of the rotating connector and the lower end is rotatably connected to the crankshaft, wherein the internal combustion engine goes through an engine cycle comprising an intake phase, a compression phase, a expansion phase, and a exhaust phase, wherein during the intake phase the piston travels from a top dead center of the cylinder to a first bottom dead center of the cylinder, wherein during the compression phase the piston travels from the first bottom dead center of the cylinder to the top dead center of the cylinder, wherein during the expansion phase the piston travels from the top dead center of the cylinder to a second bottom dead center, wherein during the exhaust phase the piston travels from the second bottom dead center of the cylinder to the top dead center, wherein the piston reaches the first bottom dead center when the off-center middle axle of the rotating connector rotates downward to a lowest point, and wherein the piston reaches the second bottom dead center when the off-center middle axle of the rotating connector rotates upward to a highest point.

2. The internal combustion engine of claim 1, wherein the rotatable receptacle comprises two holes provided in the inner surface of the side plate portion of the piston, and wherein each of the two holes comprises a plurality of bearings configured to support rotatably the rotating connector.

3. The internal combustion engine of claim 1, wherein the off-center middle axle is apart from the two rotational axles by a predetermined vertical distance, R, and wherein the R is a rotational radius of the rotating connector.

4. The internal combustion engine of claim 3, wherein a travel distance of the piston during the expansion phase or the exhaust phase is longer than a travel distance of the piston during the intake phase or the compression phase.

5. The internal combustion engine of claim 4, wherein the travel distance of the piston during the expansion phase or the exhaust phase is approximately 2.0 times R longer than the travel distance of the piston during the intake phase or the compression phase.

6. The internal combustion engine of claim 5, wherein the R is smaller than a radius of the piston.

7. The internal combustion engine of claim 1, wherein at a starting point of time of the intake phase the piston stays at the top dead center while the off-center middle axle of the rotating connector rotates downward by 180 degrees.

8. The internal combustion engine of claim 1, wherein at a starting point of time of the compression phase the piston stays at the first bottom dead center while the off-center middle axle of the rotating connector rotates upward by 180 degrees.

9. The internal combustion engine of claim 1, wherein the off-center middle axle of the rotating connector stays at a highest point without rotation during the expansion phase.

10. The internal combustion engine of claim 1, wherein the off-center middle axle of the rotating connector stays at a highest point without rotation during the exhaust phase.

11. The internal combustion engine of claim 1, wherein a fuel comprises one selected from gasoline, hydrogen, and diesel.

12. The internal combustion engine of claim 1, further comprising:

an intake valve;

an exhaust valve; and a spark plug.

* * * * *